United States Patent [19]

Morishita et al.

[11] Patent Number: 4,899,604

[45] Date of Patent: Feb. 13, 1990

[54] ENGINE STARTER

[75] Inventors: Akira Morishita; Hiroyuki Morikane; Yoshiaki Kittaka, all of Himeji, Japan

[73] Assignee: Mitsubishi Denki Kabushiki Kaisha, Tokyo, Japan

[21] Appl. No.: 299,380

[22] Filed: Jan. 23, 1989

[30] Foreign Application Priority Data

Jan. 21, 1988 [JP] Japan ..... 63-6461[U]

[51] Int. Cl.[4] ..... F02N 15/06

[52] U.S. Cl. ..... 74/7 A; 74/7 C; 74/7 E

[58] Field of Search ..... 74/7 R, 7 A, 7 E, 7 C

[56] References Cited

U.S. PATENT DOCUMENTS

| | | | |
|---|---|---|---|
| 2,862,391 | 12/1958 | Schneider et al. | 74/7 A X |
| 4,412,457 | 11/1983 | Colvin et al. | 74/7 A |
| 4,573,364 | 3/1986 | Givan | 74/7 E |
| 4,760,274 | 7/1988 | Isozumi | 74/7 A X |

*Primary Examiner*—Allan D. Herrmann

*Attorney, Agent, or Firm*—Sughrue, Mion, Zinn, Macpeak & Seas

[57] ABSTRACT

A starter motor comprising a housing, an electric motor having an output rotary shaft and mounted within the housing, an over-running clutch axially slidably mounted on the output rotary shaft, a solenoid switch for shifting the over-running clutch, and a pinion shifter assembly. The pinion shifter assembly comprises a hollow cylindrical shifter main body placed between the output rotary shaft and the housing in a slidable and rotatable engagement therewith a pinion mounted on one end of the shifter main body for rotation therewith. The shifter main body is connected at the other end thereof to the over-running clutch, and the pinion is a member assembled on the one end of the shifter main body. The pinion may be connected to the shifter main body by splines and a compression spring may be disposed between the pinion and the shifter main body for allowing an axial movement of the pinion relative to the shifter main body.

5 Claims, 2 Drawing Sheets

ENGINE STARTER

BACKGROUND OF THE INVENTION

This invention relates to an engine starter and more particularly to an engine starter for starting a vehicular engine.

FIG. 1 illustrates one example of a conventional vehicular engine starter in cross section. The engine starter comprises a housing 1 having an opening 2 in which a bearing 3 is inserted The bearing 3 rotatably supports a pinion shifter assembly 4 having a cylindrical shifter main body **4*b* and a pinion 4*a* integrally formed on the front end (right end as viewed in FIG. 1) of the shifter main body 4*b*. The shifter main body 4*b* also has integrally formed at its rear end (left end as viewed in FIG. 1) a clutch inner member 8*b* of an over-running clutch 8 which will be explained in more detail later. The engine starter also comprises an electric motor 5 (of which armature shaft only is illustrated) having an output rotary shaft 7 connected to the armature shaft 5 through a planetary speed reduction gear 6 and mounted within the housing 1. The planetary speed reduction gear 6 comprises a sun gear 5*a* formed on the armature shaft 5 of the electric motor, a plurality of planetary gears 6*a* rotatably disposed around the sun-gear 5*a* by pins on a carrier 6*b* which integrally extends from the rear end of the output rotary shaft 7, and a stationary inner gear 6*c* disposed around the planetary gears 6*a*. The rotary output shaft 7 has helical splines 7*a* with which inner teeth of a clutch outer member 8*a* of the over-running clutch 8 engage. A plurality of rollers 8*c* are disposed between the clutch outer member 8*a* and the clutch inner member 8*b* which is an integral extension of the pinion shifter assembly 4. Thus, the clutch outer and inner members 8*a* and 8*b* and the rollers 8*c* together constitute the over-running clutch 8 axially slidably mounted on the output rotary shaft 7. In order to shift the over-running clutch 8 over the output rotary shaft 7, a solenoid switch 9 connected to the over-running clutch 8 by a shift lever 10 is mounted. It is seen that the output rotary shaft 7 is supported by a bearing 12 so that it is rotatable and axially slidable relative to the output rotary shaft 7 within the pinion shifter assembly 4 The output rotary shaft 7 is provided with a stopper ring 13 at the front end of the output rotary shaft 7. Reference numeral 11 designates a spring retainer ring, which also accommodates the end arms of the shift lever 10**.

With the conventional engine starter of the construction as above described, the outer diameter of the pinion **4*a* which is integrally formed on the outer circumference of the front end of the pinion shifter main body 4*b* must not be larger than the inner diameter of the bearing 3. This is because, during assembly of the engine starter, the pinion shifter assembly 4, with the output rotary shaft 7 inserted therethrough, is inserted into the housing opening 2 with the bearing 3 fitted therein from the inside (from the left as viewed in FIG. 1) of the housing 1. Therefore, the pinion 4*a* must pass through the bearing 3, and the outer cylindrical surface of the shifter main body 4*b* must smoothly fit to the inner diameter of the bearing 3. Therefore, if it is necessary to increase the number of teeth or the outer diameter of the pinion 4*a*, the entire pinion shifter assembly 4 must be replaced with another pinion shifter 4** having an increased outer diameter of the support surface. This causes the overall dimensions and weight of the engine starter to be disadvantageously increased.

SUMMARY OF THE INVENTION

Accordingly, an object of the present invention is to provide an engine starter which is free from the above-discussed problems.

Another object of the present invention is to provide an engine starter in which the number of the teeth of the driving pinion can be changed without the need for changing the outer diameter of the pinion shifter main body.

Still another object of the present invention is to provide an engine starter in which the outer diameter of the driving pinion can be changed independently of the outer diameter of the pinion shifter main body.

Another object of the present invention is to provide an engine starter in which the pinion is axially movably mounted on the output rotary shaft.

A further object of the present invention is to provide an engine starter which can have a pinion of a larger outer diameter with a small increase in weight.

Another object of the present invention is to provide an engine starter which can have a pinion of a larger outer diameter with a small increase in overall dimensions.

With the above objects in view, the starter motor of the present invention comprises a housing, an electric motor having an output rotary shaft and mounted within the housing, an over-running clutch axially slidably mounted on the output rotary shaft, a solenoid switch for shifting the over-running clutch, and a pinion shifter assembly. The pinion shifter assembly comprises a hollow cylindrical shifter main body placed between the output rotary shaft and the housing in a slidable and rotatable engagement therewith, and a pinion mounted on one end of the shifter main body for rotation therewith. The shifter main body is connected at the other end thereof to the over-running clutch, and the pinion is a member assembled on the one end of the shifter main body. The pinion may be connected to the shifter main body by splines, and a compression spring may be disposed between the pinion and the shifter main body for allowing an axial movement of the pinion relative to the shifter main body.

BRIEF DESCRIPTION OF THE DRAWINGS

The present invention will become more readily apparent from the detailed description of the preferred embodiment of the present invention taken in conjunction with the accompanying drawings, in which.

DESCRIPTION OF THE PREFERRED EMBODIMENT

Figure 1:
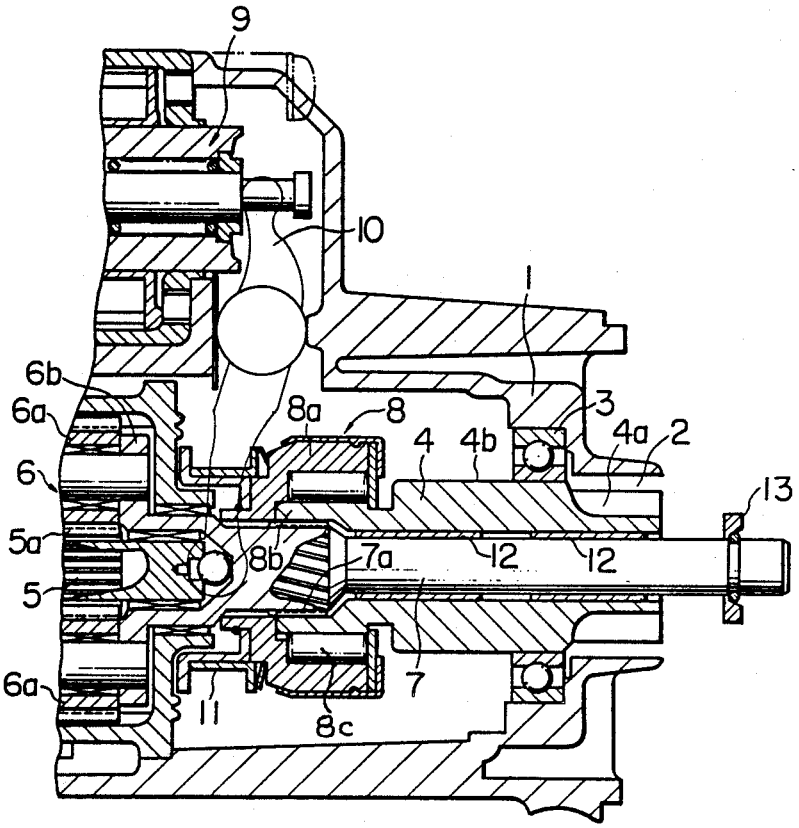
FIG. 1 PRIOR ART
FIG. 1 is a fragmental sectional view of the conventional engine starter engine.
Figure 2:
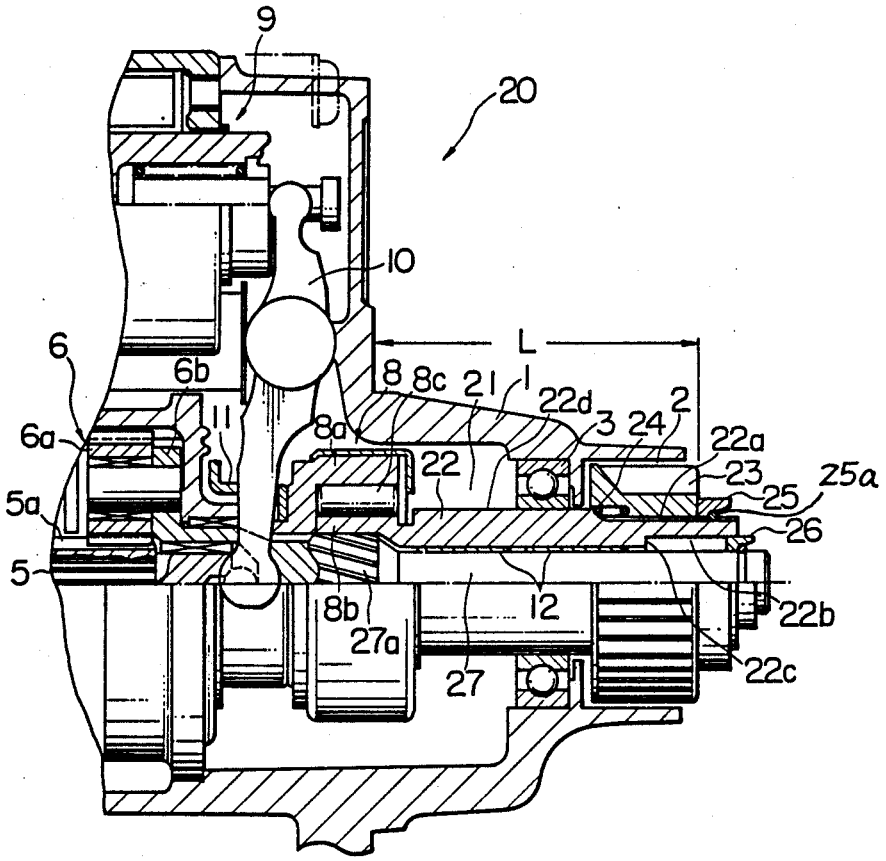
FIG. 2 a fragmental sectional view of the engine starter constructed in accordance with the present invention.

FIG. 2 illustrates in cross section one embodiment of a vehicular engine starter 20 of the present invention. The engine starter 20 comprises a housing 1 having an opening 2 in which a bearing 3 is inserted. The bearing 3 rotatably supports a pinion shifter assembly 21 having a cylindrical shifter main body 22 and a pinion 23 mounted on the front end (right end as viewed in FIG. 1) of the shifter main body 22.

The shifter main body 22 has an outer cylindrical support surface 22*d* rotatably and slidably supported by the bearing 3, a reduced diameter portion on which splines 22*a* are formed and an annular step portion defined between the support surface 22*d* and the reduced-diameter portion 22*a*. The pinion 23 has inner splines on its inner circumference which axially movably engage the splines 22*a* on the pinion shifter main body 22. The forward axial movement of the pinion 23 relative to the pinion shifter main body 22 is limited by a stopper ring 25 secured on the front end of the main body 22. In order to bias the pinion 23 toward the stopper 25, a compression spring 24 is disposed between the step portion of the shifter main body 22 and the rear end of the pinion 23. The shifter main body 22 also has integrally formed at its rear end (left end as viewed in FIG. 1) a clutch inner member 8*b* of the over-running clutch 8 which is similar to that of the conventional design shown in FIG. 1.

The engine starter also comprises an electric motor 5 (of which armature shaft only is illustrated) having an output rotary shaft 27 connected to the armature shaft 5 through a planetary speed reduction gear 6 and mounted within the housing 1. The planetary speed reduction gear 6 comprises a sun gear 5*a* formed on the armature shaft 5 of the electric motor, a plurality of planetary gears 6*a* rotatably disposed around the sun-gear 5*a* by pins on a carrier 6*b* which integrally extends from the rear end of the output rotary shaft 27, and a stationary inner gear 6*c* disposed around the planetary gears 6*a*.

The rotary output shaft 27 has helical splines 27*a* with which inner teeth of a clutch outer member 8*a* of the over-running clutch 8 engage. A plurality of rollers 8*c* are disposed between the clutch outer member 8*a* and the clutch inner member 8*b* which is an integral extension of the pinion shifter assembly 21. Thus, the clutch outer and inner members 8*a* and 8*b* and the rollers 8*c* together constitute the over-running clutch 8 axially slidably mounted on the output rotary shaft 27.

In order to shift the over-running clutch 8 over the output rotary shaft 27, a solenoid switch 9 connected to the over-running clutch 8 by a shift lever 10 is mounted. It is seen that the output rotary shaft 27 is supported by a bearing 12 disposed between the output rotary shaft 27 and the pinion shifter assembly 21 so that it is rotatable and axially slidable relative to the output rotary shaft 27 within the pinion shifter assembly 21. The output rotary shaft 27 is provided with a stopper ring 26 at its front end The stopper ring 26 is disposed within a cavity 22*b* formed in the pinion shifter main body 22 so that it engages against the step portion 22*c* when the pinion shifter assembly 21 is driven forward. This arrangement allows the rotary output shaft to be significantly shorter than an ordinary arrangement in which no such cavity is provided.

In the assembly of the engine starter of the present invention of the above-construction, the pinion shifter main body 22 connected to the over-running clutch 8 and placed over the output rotary shaft 27 is inserted into the bearing 3 secured to the housing 1 to extend therethrough from the inside of the housing 1. This insertion can be very easily achieved because the pinion 23 is not yet mounted on the pinion shifter main body 22. Then, from the outside of the housing 1, the spring 24 is placed over the splined portion 22*a* of the shifter main body 22 and the pinion 23 is placed over the shifter main body 22 with the splines therebetween in engagement. Then, a stopper ring 25 is fitted and held in place by a snap ring 25*a* with the spring 24 compressed between the pinion 23 and the step portion between the cylindrical support surface 22*d* and the splined, reduced-diameter portion 22*a*.

With the engine starter of the present invention, since those components of the pinion shifter assembly 21 mounted on the shifter main body 22 outside of the housing or front side with respect to the bearing 3 are separate parts which can be assembled after the pinion shifter main body 22 is inserted in the bearing 3, no limitation due to the inner diameter of the bearing 3 is imposed upon the outer diameter of those components. Therefore, the outer diameter of the pinion 23 can be larger than the inner diameter of the bearing 3. If it is necessary to increase the number of the teeth or the outer diameter of the pinion 23 in order to adapt for a different type of engine, only the pinion 23 can be replaced with another pinion suitable for that particular engine and there is no need to replace the entire pinion shifter assembly 2. This prevents the overall dimensions and weight of the engine starter from being disadvantageously increased.

As has been described, the pinion mounted to front end of the pinion shifter main body is a member assembled after the pinion shifter main body is inserted into the bearing, so that the number of the teeth and/or the outer diameter of the driving pinion can be independently changed without the need for changing the outer diameter of the pinion shifter main body. This eliminates the inevitable increase in dimension and weight of the conventional engine starter in correspondence with the increased outer diameter of the sliding support surface of the pinion shifter main body when the outer diameter of the pinion is large. Also, since the outer diameter of the sliding support surface of the pinion shifter main body does not have to be large even when the pinion is large, the housing can have a thicker wall in its front support portion, significantly increasing the strength of the housing. This enables the design of the so-called front nose starter in which the length L (FIG. 2) between the pinion front end and the mounting surface of the housing is long to be easily achieved.

What is claimed is:

1. A starter motor, comprising:

a housing (1);

an electric motor (5) having an output rotary shaft (27) and mounted within said housing;

an over-running clutch (8) axially slidably mounted on said output rotary shaft;

a solenoid switch (9) for shifting said over-running clutch;

a pinion shifter assembly (21) having a cylindrical shifter main body (22) disposed surrounding and in slidable and rotatable engagement with said output rotary shaft, and disposed within and in slidable and rotatable engagement with a bearing (3) mounted in an outer end of said housing, said shifter main body being connected att one end thereof to said over-running clutch, and, a pinion (23) detachably mounted on another opposite end of said shifter main body extending outwardly of said bearing and housing for rotation with said shifter main body, said pinion being externally accessible and removably assembled on said another end of said shifter main body.

2. An engine starter as claimed in claim 1, wherein said pinion is axially slidable relative to said shifter main body.

3. An engine starter as claimed in claim 1, wherein said pinion is axially slidably connected to said shifter main body by splines (22*a*).

4. An engine starter as claimed in claim 1, wherein said pinion shifter assembly further comprises a compression a spring (24) disposed between said pinion and said shifter main body for allowing an axial movement of said pinion relative to said shifter main body.

5. An engine starter as claimed in claim 1, wherein the outer diameter of the pinion is greater than the maximum diameter of the shifter main body.

* * * * *